United States Patent [19]

Boskovic

[11] Patent Number: 4,772,240

[45] Date of Patent: Sep. 20, 1988

[54] MULTI-COMPARTMENT SORTING TOY

[76] Inventor: Boris Boskovic, 2102 Bannockburn, Inverness, Ill. 60067

[21] Appl. No.: 926,975

[22] Filed: Nov. 4, 1986

[51] Int. Cl.[4] ..... A63H 29/08; A63B 67/14

[52] U.S. Cl. ..... 446/170; 446/173; 273/109

[58] Field of Search ..... 446/170, 168, 171, 173; 273/109, 110, 113

[56] References Cited

U.S. PATENT DOCUMENTS

| | | | |
|---|---|---|---|
| 1,471,375 | 10/1923 | Bowman | 273/113 |
| 2,467,781 | 4/1949 | Ribbe | 446/168 |
| 2,662,336 | 12/1953 | Zalkind | 446/170 |
| 2,752,725 | 7/1956 | Unsworth | 273/109 X |
| 3,005,635 | 10/1961 | Greene | 446/170 X |
| 3,118,676 | 1/1964 | Louis | 273/109 |
| 3,135,512 | 6/1964 | Taylor | 273/109 |
| 3,399,894 | 9/1968 | Smith | 446/170 X |
| 3,747,937 | 7/1973 | Fabricani | 273/153 R |
| 3,840,234 | 10/1974 | Felsten | 273/113 |
| 3,901,510 | 8/1975 | Demaio | 273/113 |
| 4,376,537 | 3/1983 | Yokoi | 273/153 S |
| 4,413,823 | 11/1983 | Breslow | 273/153 S |
| 4,451,038 | 5/1984 | Nagy | 273/110 |
| 4,557,701 | 12/1985 | Giallombardo | 446/170 |

*Primary Examiner*—Robert A. Hafer
*Assistant Examiner*—D. Neal Muir
*Attorney, Agent, or Firm*—Lee & Smith

[57] ABSTRACT

A sorting-type toy comprising a series of angularly spaced compartments, each separated by a divider having an aperture therethrough. A plurality of colored or otherwise identifiable balls are located in the compartments and are sorted by the user through the apertures until all balls of one type or alignment are located in each of the compartments.

12 Claims, 1 Drawing Sheet

MULTI-COMPARTMENT SORTING TOY

BACKGROUND OF THE INVENTION

This invention relates to sorting-type toys, and in particular to a multi-compartment sorting toy used both for enjoyment and also to enhance dexterity.

Sorting-type toys utilizing balls passing between compartments are known, as illustrated by U.S. Pat. Nos. 3,840,234 and 4,451,038. The former patent relates to a tetrahedron having internal compartments, some of which having apertures to permit a ball to pass from compartment to compartment. The latter patent is spherical with internally manipulatable dividers having openings to permit passage of a marble or a die. Other types of toys utilizing balls are known, as exemplified by U.S. Pat. Nos. 3,747,937; 3,901,510; 4,376,537 and 4,413,823. Such devices test the skill of a user by requiring passage of a ball in some manner internally within the device.

While the above-identified patents have disclosed various devices requiring user skill and manipulation, none pertains to a recreational type toy permitting internal sorting of variously-identified balls into a series of angularly-spaced compartments. The interest of a user is often rapidly lost if the device is too difficult to operate or too difficult to learn to operate.

SUMMARY OF THE INVENTION

The present invention relates to a sorting-type of toy which includes an elongated housing having a central longitudinal axis and a transparent outer shell. A plurality of flat, elongated dividers are located within and extend the length of the housing, each divider having an inner edge which adjoin one another and which lie substantially coextensive with the longitudinal axis. The dividers extend radially outwardly from the longitudinal axis to an outer edge which extends adjacent the outer shell of the housing. Adjacent dividers define between them a compartment within the housing, with a plurality of such compartments being located in the housing. A plurality of balls are located in the housing, and an aperture is located through each divider, with the apertures being dimensioned so that they are at least as large as the diameter of each of the balls in order to permit the balls to pass freely through the apertures from compartment to compartment.

In accordance with the preferred embodiment of the invention, the housing is cylindrical, and includes a permanently-affixed cap at each end thereof in order to seal the housing. While four dividers are preferred within the housing, spaced at 90° intervals in order to form four of the compartments, any number of dividers greater than two can be employed as desired to create as many compartments as there are dividers.

The adjoining inner edges of the adjacent dividers form a trough in order to permit the balls to travel to and fro in each compartment along the trough. Each aperture is spaced from the trough a distance less than the diameter of the ball, with the closeness of the aperture to the trough determining, to some extent, the degree of difficulty of utilization of the toy.

Each of the balls is identified in some manner. For example, each ball may carry an identifying color, with the number of colors preferably equaling the number of compartments in the toy, and with a plurality of balls of each color being provided for sorting difficulty. Alternatively, each ball may be identified by a particular number. Similarly, balls can be identified by letters, different sizes, different shapes, and different surface textures.

In a similar manner, each of the compartments is separately identified. In accordance with the preferred embodiment of the invention, each compartment is of a different color, with each compartment color corresponding to colors of balls intended to be sorted into the compartment.

BRIEF DESCRIPTION OF THE DRAWING

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
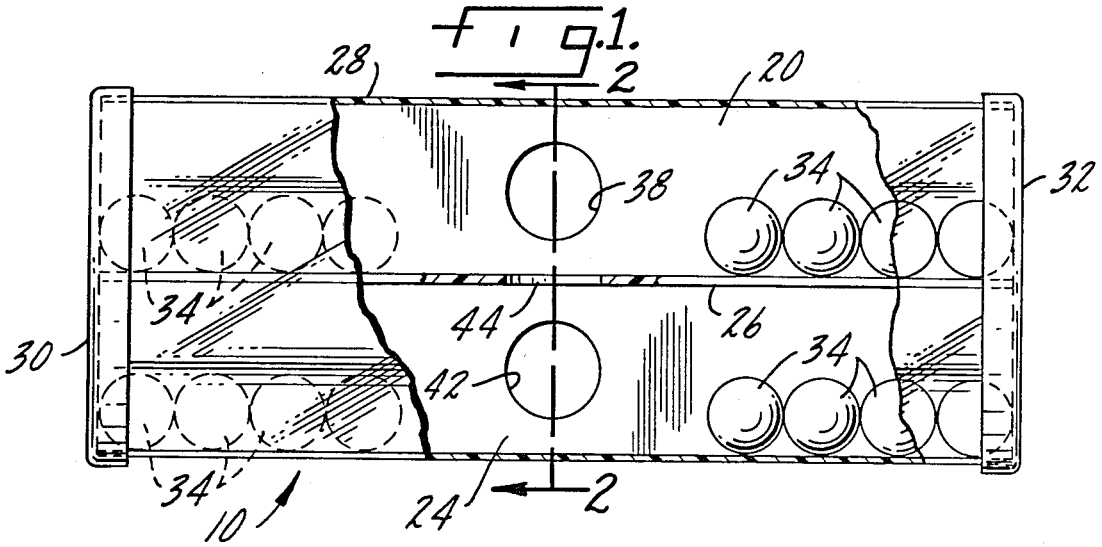
FIG. 1 is an elevational view, partly in cross section, illustrating the sorting-type toy according to the invention.
Figure 2:
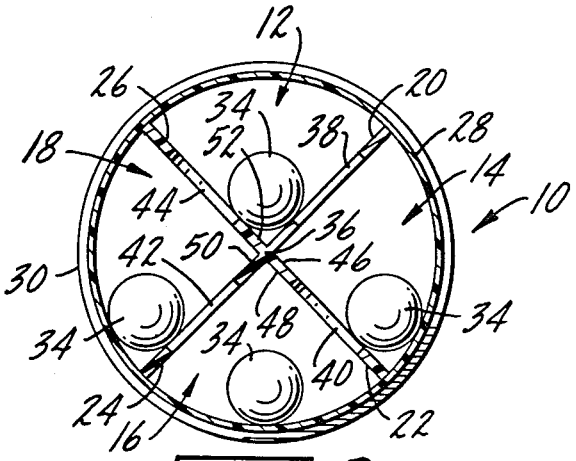
FIG. 2 is a cross-sectional view taken along lines 2—2 of FIG. 1 with the toy rotated about its axis 45° from that illustrated in FIG. 1.

The multi-compartment sorting-type toy according to the invention is designated generally at 10 in FIGS. 1 and 2. The toy 10 illustrated includes separate compartments 12, 14, 16 and 18 which are separated by flat, elongated dividers 20, 22, 24 and 26, as best illustrated in FIG. 2. The dividers 20 through 26 are contained within a housing having a transparent outer shell 28, and including end caps 30 and 32 on the opposite ends thereof.

A plurality of balls 34 are contained in the toy 10. Preferably, four balls are provided for sorting into each compartment, and thus sixteen balls 34 are provided in the four-compartment toy 10. However, as should be evident, any number of the balls 34 may be employed, and therefore the number of balls may vary depending upon the utility of the toy 10 and difficulty of sorting desired. Additional balls 34 are shown in phantom.

As best illustrated in FIG. 2, the dividers 20 through 26 radiate from a central longitudinal axis 36 of the toy 10. The respective dividers 20 through 26 each include an aperture 38, 40, 42 or 44, which, as illustrated, are positioned to permit the balls 34 to pass freely from compartment to compartment.

Adjoining inner edges of adjacent ones of the dividers 20 through 26 form a trough in each of the compartments 12 through 18. Four such troughs 46, 48, 50 and 52 are formed. As shown in FIG. 2, each of the apertures 38 through 44 is spaced from its corresponding trough 46 through 52 a distance less than the diameter of each of the balls 34. The closer the location of an aperture to a trough, the more difficult manipulation of the toy 10 becomes because the balls 34 can more freely pass from compartment to compartment as the troughs 46 through 52 become shallower.

Likewise, the diameter of each of the apertures 38 through 44 has a direct bearing on the difficulty of manipulation of the toy 10. As best shown in FIG. 2, the balls 34 in the compartments 14 and 18 are illustrated contained between the dividers 22 and 24 and the outer shell 28. As will be evident, the larger the apertures 40 or 42, the more readily one of the balls 34 may be caused to pass through the apertures into the lower compartment 16.

Figure 3:
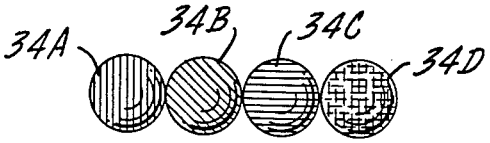
FIG. 3 illustrates balls of four different colors for use in the toy.

For the ease of explanation, the balls 34 in FIGS. 1 and 2 are not identified by any color or marking, nor are the compartments 12 through 18. As explained above, preferably each of the compartments is separately identified, such as by a different color, for example the compartment 12 being red, the compartment 14 being green, the compartment 16 being blue and the compartment 18 being yellow. For sorting purposes, the balls 34 are similarly colored. Four balls 34 lined for four different colors are illustrated in FIG. 3, the ball 34A being lined for red, the ball 34B being lined for green, the ball 34C being lined for blue, and the ball 34D being lined for yellow. Given four compartments 12 through 18 and sixteen of the balls 34, four of the balls would similarly colored as each of the balls 34B, 34B, 34C and 34D.

The balls 34 roll freely to and fro within the compartments 12 through 18 as the toy 10 is tilted. Also, depending on the rotation of the toy 10, as the toy is tilted, some of the balls may pass through respective apertures 38 through 44 into adjacent compartments. The purpose of the toy 10 is, by skillful manipulation, to gather all of the red balls 34A in the red compartment, all the green balls 34B in the green compartment, all the blue balls 34C in the blue compartment and the yellow balls 34D in the yellow compartment. Alternatively, balls of one color may be sorted into a compartment of a different color (such as sorting all the red balls into the green compartment, etc.). Also, one ball 34 of each color can be sorted into each of the compartments in the alignment illustrated in FIG. 3. Other means of sorting and arranging of the balls 34 in the compartments 12 through 18 may be devised, as suits the manipulator of the toy 10.

Figure 4:
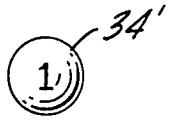
FIG. 4 illustrates identification of a ball alternatively by a number.

While, in accordance with the embodyment of the invention described above, the balls 34 are variously colored for identification purposes, the balls 34 may just as readily be identified by other means, such as by numbers. Illustrated in FIG. 4 is a ball 34' bearing a numeral. Similar to the balls 34A through 34D, if four compartments are located in the toy 10 and sixteen balls 34' are employed, four of the balls 34' may bear the numeral 1, four of the balls 34' may bear the numeral 2, four of the balls may bear the numeral 3 and four of the balls may bear the numeral 4. The compartments 12 through 18 can be similarly numbered, colored, or otherwise identified for sorting of the numbered balls 34'.

As explained above, in addition to the variations immediately preceding, other variations are quite apparent. For example, the number of compartments may vary from that illustrated. In addition, the number of balls 34 may be varied as desired, and in addition to identifying the balls by color or number, the balls can be identified by letters, size, shape or surface texture. The compartments for the balls 34 can likewise be identified by other means. In addition, although one aperture 38 through 44 is illustrated through the respective dividers 20 through 26, it should be evident that more than one aperture can be located in each of the dividers, or an aperture can be omitted entirely from one of the dividers while still permitting transfer of the balls 34 from compartment to compartment. Also, while the exterior configuration of the toy 10 is preferably cylindrical, it will be evident that other shapes will function equally as well.

Various changes can be made to the invention without departing from the spirit thereof or scope of the following claims.

What is claimed is:

1. A sorting-type toy comprising a. an elongated, closed housing have a normally horizontally-disposed central longitudinal axis and transparent outer shell extending generally parallel to said axis, b. a plurality of flat, elongated dividers within and extending the length of the housing, each divider having an inner edge adjoining one another and lying substantially coextensive with said longitudinal axis and said dividers extending radially outwardly from said longitudinal axis, each divider also having an opposite outer edge extending adjacent said outer shell, and with adjacent dividers defining therebetween a compartment within said housing, said housing having a plurality of said compartments, c. a plurality of balls within said housing, d. an aperture through each divider, said apertures being dimensioned at least as large as the diameter of each said ball to permit said balls to pass freely therethrough from compartment to compartment upon rotation of said toy about said longitudinal axis, and e. the adjoining inner edges of adjacent dividers forming a trough for said balls, each aperture being spaced from said trough a distance less than the diameter of each said ball.

2. A toy according to claim 1 in which said housing is cylindrical, and including a cap at each end thereof.

3. A toy according to claim 1 including four of said dividers spaced at 90° intervals forming four of said compartments.

4. A toy according to claim 1 including means for identifying each said ball.

5. A toy according to claim 4 in which said identifying means comprises a color for each ball.

6. A toy according to claim 4 in which said identifying means comprises a number on each ball.

7. A toy according to claim 1 including means for separately identifying each compartment.

8. A toy according to claim 7 in which said means for separately identifying comprises a different color for the dividers of each compartment.

9. A sorting-type toy comprising a. an elongated closed, cylindrical housing having a normally horizontally-disposed central longitudinal axis and a transparent outer shell extending generally parallel to said axis, b. four flat, elongated dividers within and extending the length of the housing, each divider having an inner edge ajoining one another and lying substantially coextensive with said longitudinal axis with said dividers extending radially outwardly from said longitudinal axis spaced at 90° intervals, and with adjacent dividers defining therebetween a compartment within said housing, said housing having four of said compartments, c. a plurality of balls within said housing, d. means for identifying each said ball in relation to said compartments, e. an aperture through each divider, said aperture being dimensioned at least as large as the diameter of each said ball to permit said balls to pass freely therethrough from compartment to compartment upon rotation of said toy about said longitudinal axis, and f. the adjoining inner edges of adjacent dividers form a trough for said balls, each aperture being spaced from said trough a distance less than the diameter of each said ball.

10. A toy according to claim 9 in which said identifying means comprises a color for each ball with each ball being one of four different colors and a different one of said four colors for each compartment.

11. A toy according to claim 9 in which said identifying means comprises a number on each ball with each ball being numbered with one of at least four different numbers.

12. A toy according to claim 11 in which each compartment bears a different one of each of said numbers.

* * * * *